United States Patent [19]

Henry

[11] Patent Number: 4,593,628

[45] Date of Patent: Jun. 10, 1986

[54] HEATING UNIT

[76] Inventor: Donald D. Henry, 290 Wainoni Road, Christchurch, New Zealand

[21] Appl. No.: 696,113

[22] Filed: Jan. 29, 1985

Related U.S. Application Data

[63] Continuation-in-part of Ser. No. 595,679, Apr. 2, 1984, abandoned.

[51] Int. Cl.[4] ..... F23K 3/14

[52] U.S. Cl. ..... 110/101 R; 110/102; 110/293; 110/267

[58] Field of Search ..... 237/55, 54; 110/102, 110/101 R, 218, 219, 220, 267, 101 CF, 101 C, 101 CD, 293

[56] References Cited

U.S. PATENT DOCUMENTS

| | | | |
|---|---|---|---|
| 940,567 | 11/1909 | Wales | 237/11 |
| 3,865,053 | 2/1975 | Kolze et al. | 110/102 X |
| 3,999,710 | 12/1976 | Kemmerer | 237/55 |
| 4,517,903 | 5/1985 | Richmond et al. | 110/102 X |

*Primary Examiner*—Henry Bennett
*Attorney, Agent, or Firm*—Holman & Stern

[57] ABSTRACT

A particulate material fired convection heating unit including a combustion chamber, a shaped flue duct, and a fan means to draw therefrom gases and draw them through at least one convector pipe before the flue gases return and pass to a flue to be allowed to escape to atmosphere. The firebox has in association therewith a duct through which the flue gases are drawn to a free standing convector unit in which the convector pipes are situated and around which ambient air circulates to be heated to thereby heat an area in which the convector unit is situated. In an industrial, horticultural and agricultural situation the heating unit can be associated with a firebox of a particulate coal, wood, woodwaste or oil fired boiler or burner. The free standing convector unit thereof can be sited in a glasshouse or factory so that heat convected therefrom heats the ambient air in which the convector unit is sited. A fuel feeding apparatus includes a storage unit having an inflatable liner on the base thereof, a feed tube connected between the storage unit and a fuel supply chamber which feeds fuel to the combustion chamber, and a suction device connected by tubes to the fuel supply chamber for drawing fuel and air from the storage unit through the feed tube to the fuel supply chamber and suction device from which the air exits to atmosphere.

19 Claims, 16 Drawing Figures

HEATING UNIT

This is a Continuation-in-Part application of U.S. Ser. No. 595,679, filed Apr. 2, 1984, now abandoned.

BACKGROUND OF THE INVENTION

1. Field of the Invention

The invention relates to a particulate material fired heating unit and more particularly relates to a heating unit fired by particulate material and adapted to supply heat for domestic, industrial and agricultural use.

2. Description of the Prior Art

A well known fact associated with heating units or appliances designed to burn fossil fuels and other organic matter is that a high percentage of heat is lost through natural convection as the combustion exhaust gases rise through a flue pipe of the unit or appliance.

In addition a problem associated with the feeding of particulate materials as a fuel to a boiler or heating unit is the feeding of wet or dry saw dust, coal dust or other particulate materials. The particulate material has a tendency to be difficult to feed as it clogs normal feeding systems and/or feeds unevenly. This is particularly the case with feeding over long distances in situations where a fuel hopper is spaced some distance from the boiler or heating unit.

BRIEF SUMMARY OF THE INVENTION

An object of the invention is therefore to provide a heating unit with an improved heat output produced by extracting and utilizing efficiently fuel input and by utilizing efficiently hot exhaust gases from combustion which gases are normally wasted to the atmosphere.

A further object of the invention is to make more efficient use of heat normally lost to the atmosphere through a flue of a heating unit and to provide a heating unit adapted to apply this heat for useful purposes.

An object of the invention is to provide a fuel supply means which overcomes at least in part the abovementioned disadvantages and to provide a means for supplying a particulate fuel to a boiler or similar heating unit.

According to one aspect of the invention there is provided a convection heating unit in combination with a heating appliance of the type having a combustion space, the heating unit including a flue duct connected to the combustion space and adapted via fan means to draw flue gases from said space and direct them to a pipe or pipes formed into continuous serpentine shapes which form a path associated with said unit and which act by convection to give up heat transferred from the flue gases therein, and means to direct the flue gases from the pipe(s) to a flue leading to atmosphere.

According to another aspect of the invention there is provided a means for supplying fuel to a boiler or similar heating unit the means including connecting an outlet port of a storage unit to one end of a feed tube, providing in the storage unit means for loosening material therein, attaching the other end of the feed tube to a fuel supply chamber at or near to a combustion chamber, connecting a suction device to the supply chamber to draw loosened fuel from the storage unit through the feed tube to the supply chamber from which the fuel is fed directly or by a conveying means to the combustion space of a boiler or heating unit.

In industrial, horticultural and agricultural situations the heating unit can be associated with a firebox of a particulate coal, wood, woodwaste or oil fired boiler/- burner. The free standing convector unit thereof can be situated in a glasshouse or factory so that heat convected therefrom heats the ambient air therein.

Alternatively the heating unit as hereinbefore described can be supplied by fuel via a feeding means, the feeding means including a hopper, an endless conveyor and a feed conveyor, the arrangement being such that the endless conveyor floats relative to the hopper and is positioned so that it conveys fuel in the hopper over the rim thereof to one end of the endless conveyor which moves the fuel to the heating appliance.

The fan means for drawing the combustion gases to the flue can include a centrifugal fan positioned in the flue and adapted to draw the exhaust gases through a central inlet the periphery of which is sealed by a seal which contacts the side of the centrifugal fan.

BRIEF DESCRIPTION OF THE DRAWINGS

Embodiments of the invention will now be described in detail with reference to the accompanying drawings wherein.

DETAILED DESCRIPTION OF THE PREFERRED EMBODIMENTS

Figure 1:
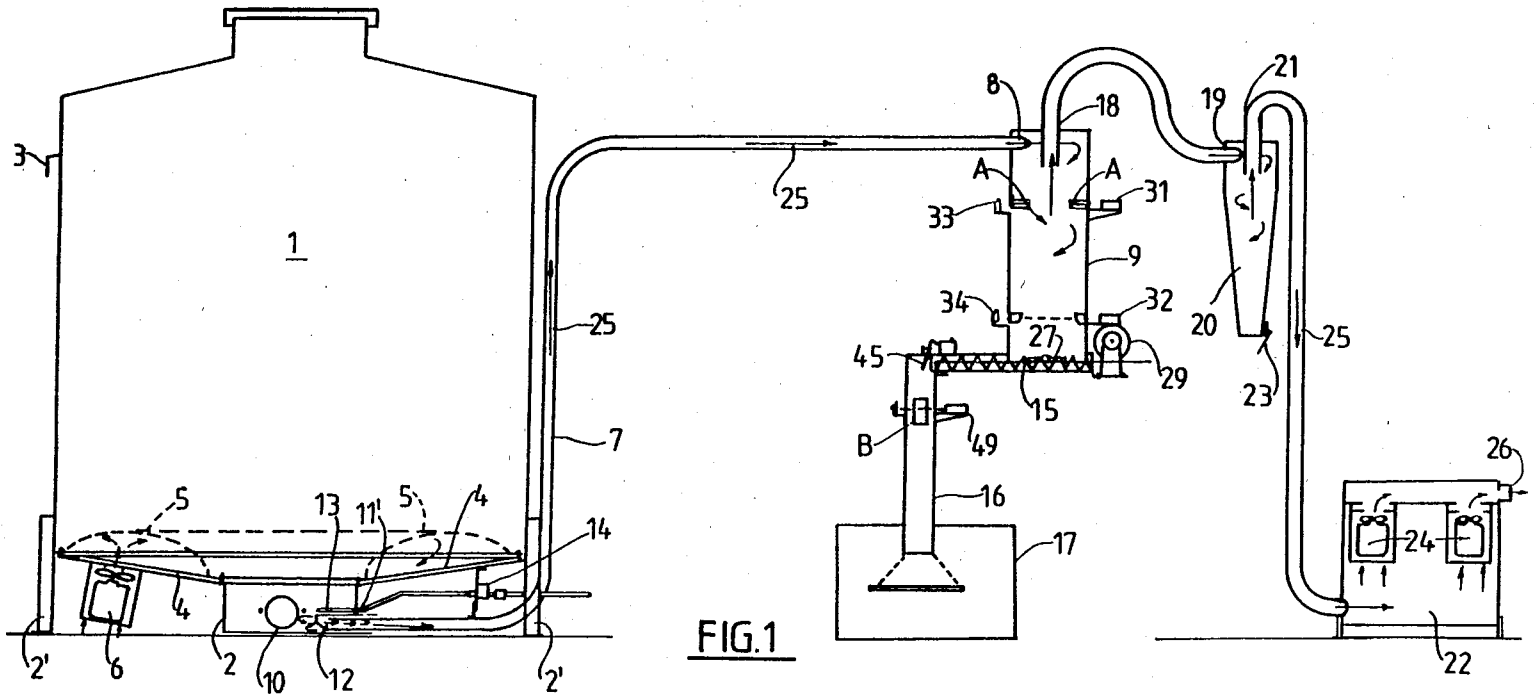
FIG. 1 is a schematic side elevational view of a heating system including a means for supplying fuel to a boiler thereof in accordance with the invention.

In the following description similar parts of the different embodiments of the invention have been referenced by the same numerals.

The present invention requires a burning or combustion space for a fire which is, preferably, adapted to burn particulate coal, wood, woodwaste or other fossil fuels which can be dry or semi-dry.

The heating unit is mounted in association with a heating appliance which includes a combustion space or chamber. The invention can be used with a vented fuel storage silo 1 which is periodically filled with additional fuel when inspection through a vent or level inspection port 3 shows additional fuel is required.

The silo 1 is mounted on legs 2' and has a base which tapers to an outlet port or well 2. The interior of the silo 1 can include a means for maintaining the fuel in a loose or free running condition. For example, the silo 1 has a floor 4 fitted with an annular inflatable floor line 5 in FIGS. 1 and 3 the inflated position is shown in dashed lines 5'. A low pressure fan 6 supplies air to periodically raise the floor liner 5. This raising and lowering movement maintains the fuel at the base in free flowing condition on the base 4 of the silo 1.

The outlet port or well 2 has connected thereto a feed tube 7 which is a length of flexible, semi-rigid or rigid tube the other end 8 of which is connected to a fuel supply chamber 9.

Figure 3:
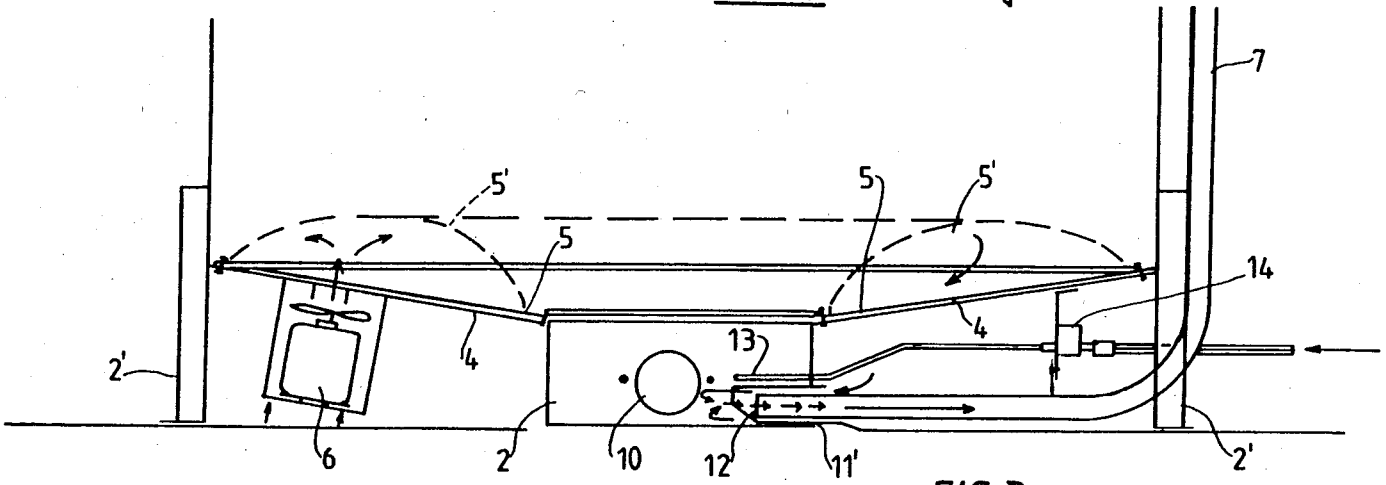
FIG. 3 is an enlarged view of an example of means for loosening the fuel in the storage unit shown in FIG. 1.

The well 2 includes a removable inspection cover 10 and the connection between the feed tube 7 and the well 2 can be as shown in FIG. 3 in the form of a gulper with a larger shaped air inlet tube 11' mounted generally concentrically with the end 12 of the tube 7. The provision of such a gulper device ensures that little or no clogging is likely to occur. Additionally the well 2 can have a series (in the example only one is shown FIG. 3) of cutting jets 13. The cutting jets are connected to a high pressure air supply (for example about 100 p.s.i.) compressor via a solenoid valve 14 which is normally in a closed position when power is not connected to the system.

The chamber 9 is preferably a metal cylinder which has one or more inspection covers.

Figure 2:
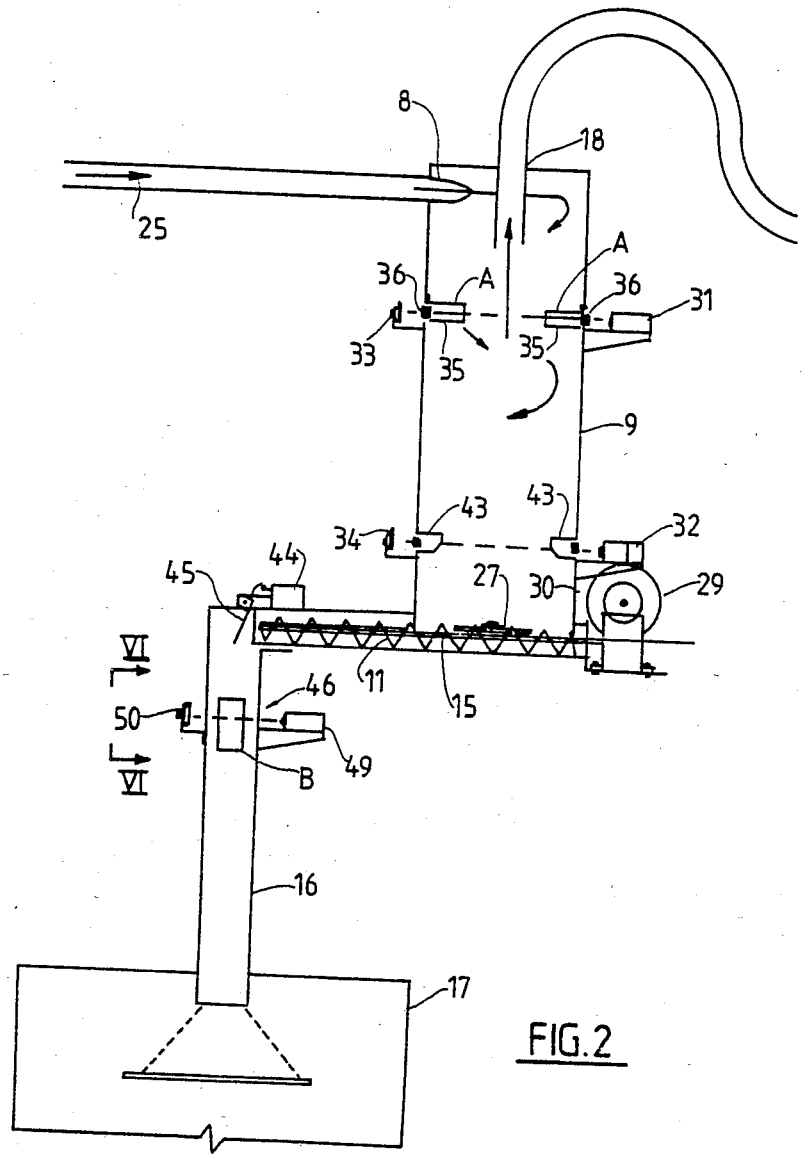
FIG. 2 is an enlarged view of the fuel supply chamber, conveying means and feed pipe of FIG. 1.
Figure 8:
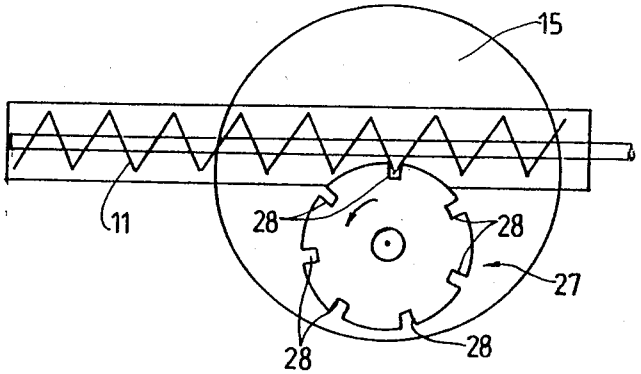
FIG. 8 is an enlarged partial top plan view of the bottom or base of the fuel supply chamber shown in FIGS. 1 and 2.

The chamber 9 has in a base 15 thereof a conveying means 11 (shown in FIGS. 1, 2 and 8) which feeds the fuel when the system is operating to an inlet chute 16 of a heating unit only the outline 17 of which is shown in FIGS. 1 and 2. The other end 8 of the feed tube 7 is connected tangentially to the side of an upper edge of the chamber 9 which also has a suction outlet pipe 18 connected at the top thereof. The outlet pipe 18 is connected, for example, at its other end 19 to a cyclone filter 20 an outlet 21 from which is connected to a suction device 22. The cyclone filter 20 acts as a waste collection chamber from which particles can fall when flap valve 23 is open. The suction device 22 is a series of fans 24 adapted to draw air in the direction of arrows 25 through the tube 7 and pipe 18 before it exits at 26 from the device 22. This flow of air produces a cyclonic action in the chamber 9 and cyclone filter 20 before the air is expelled from outlet 26 of the suction device 22.

The base 15 of the chamber 9 which has the conveying means 11 therein can additionally include means 27 (shown in detail in FIG. 8) for feeding the fuel from each side of the base of the chamber 9 toward the conveying means 11. The means 27 is driven by the worm feed of the conveying means 11 by providing slots 28 in the periphery of the discs.

The conveying means 11 is driven by a drive motor 29 via a gearbox 30 the control for which is described hereafter.

Figure 4:
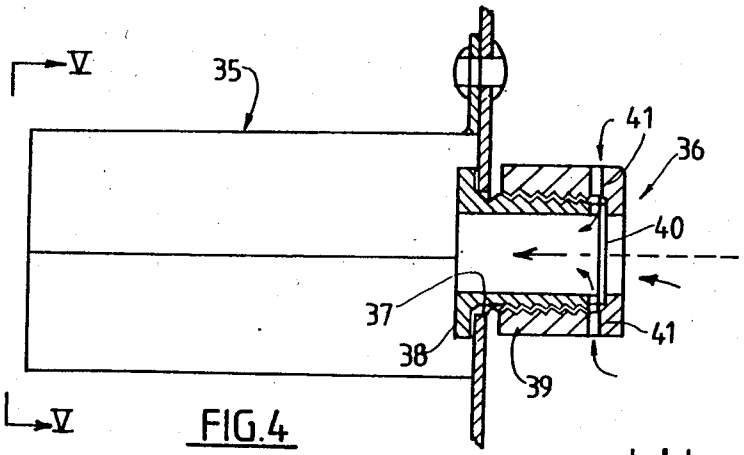
FIG. 4 is an enlarged cross-sectional view through a self cleaning stream splitting sensor of the type incorporated at A in the fuel supply chamber shown in FIGS. 1 and 2 which is adapted to activate or deactivate operation of the fuel supply of fuel being supplied to the supply chamber.
Figure 5:
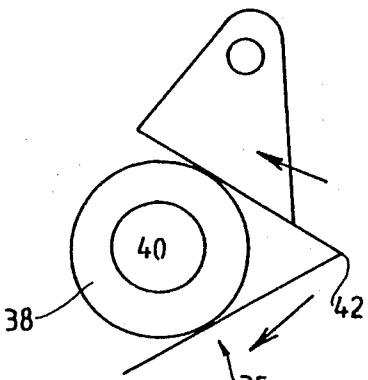
FIG. 5 is a view taken along line V—V of the splitter shown in FIG. 4.

The chamber 9 also has a pair of sensing means 31 and 32 respectively. The sensing means can be infra-red transmitters which with the corresponding reflectors 33 and 34 control operation of the fuel supply means. The upper sensing means 31 and the upper reflector 33 are shrouded against the moving fuel initially deactivating the infra-red beam by including a particle stream splitter as shown in FIGS. 4 and 5. The splitter is indicated by arrow 35 and is fixed to cover a self cleaning window 36 on either side of the chamber 9. The splitter 35 is arrow shaped in section (FIG. 5) and covers the window 36 which is fixed to a hole 37 in the side wall of the chamber 9. The parts 38 and 39 forming the supports for the glass 40 can be molded plastics fittings of the type used to pass electric wiring through metal fittings.1 The part 39 has a pair of apertures 41 (FIG. 4) through which air can pass in the direction of the arrows shown. The sensing means 31 and 33 are mounted adjacent the outside of the chamber 9. The splitter 35 for the reflector is positioned so that its leading edge 42 faces the particles moving in a cyclonic manner in the upper region of the chamber 9.

The other sensing means 32 and its associated reflector 34 are also shrouded by shrouds 43 which are of the shape shown (FIG. 2) in side elevation and the shape of an inverted U in cross-section.

The operation of the fuel supplying means can be controlled by an electronic controller (not shown) which automatically feeds fuel from the silo 1 to the chamber 9 and from the chamber 9 to the feed tube 16. In the example shown control of the operation of the means as well as including the sensors 31 and 32 has a micro-switch 44 activated by a flap valve 45 at the end of the conveying means 11. The valve 45 operates to shut down the drive motor 29 of the conveying means 11 if the feed tube 16 is full and the worm/auger continues to operate.

Figure 6:
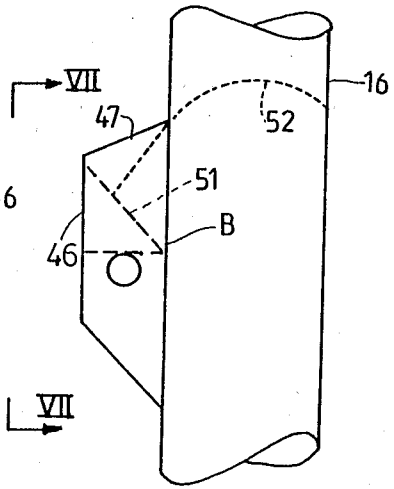
FIG. 6 is an enlarged view taken along line VI—VI of FIG. 2 of a feed level control box for a feed tube usable in the example shown in FIG. 2.
Figure 7:
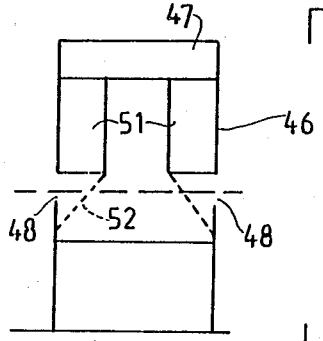
FIG. 7 is an enlarged view taken along line VII—VII of FIG. 6 of the fuel feed level control box shown in FIG. 6.

The normal operation of the motor 29 is controlled by the level of fuel in the feed tube 16. This is via a fuel feed control box 46. The control box is shown in detail in FIGS. 6 and 7 and has a portion of the side wall of the tube 16 at B removed. A shaped cover 47 is fixed over the removed portion. The cover 47 has a pair of opposed apertures 48 through which an infra-red beam from sensor 49 to reflector 50 can pass when the tube 16 is empty. The cover 47 has a pair of inwardly directed baffles 51 which restrict the amount of fuel which can spill into the cover 47 from the tube 16. The contours of the fuel level are dashed at 52. This ensures that even if the level partly fills the cover 47 it is not possible for the fuel to spill through the apertures 48.

The controller at start up with the chamber 9 empty and with no fuel in the conveying means 11 and tube 16 empty makes the sensor beams 31 and 32. As soon as both sensors 31 and 32 are made the vacuum or suction device 22 operates at the same time as the solenoid valve 14 is opened and the low pressure fan 6 begins to operate. The solenoid valve 14 and fan 6 continue to operate in a controlled manner while the suction device 22 operates. The suction device 22 draws air through the feed tube 7, chamber 9, outlet pipe 18, cyclone filter 20, and outlet 21 before it is exhausted through the outlet 26. This flow of air in the direction of the arrows indicated closes the flap valve 23 and flap valve 45 and draws air past the windows 36 via the apertures 41. Air is also drawn into the gulper device in the well 2 via the inlet tube 11'. The movement of the liner 5 and the cutting action of the jets 13 allows the air flow to draw the loosened fuel into the tube 7 and on into the chamber 9 which fills until the accumulated fuel closes first the sensor 31 and second the sensor 32 which closes down the suction device 22. At this point if there is no fuel in the feed tube 16 the sensor 49 activates the motor 29 of the conveying means 11. This moves the fuel past the flap valve 45 to drop into the feed tube 16 until the fuel level then builds up as the fuel in the combustion chamber rises. When the fuel level reaches and closes sensor 49 the motor 29 is deactivated until the fuel again drops at which point provided the fuel level is above the bottom sensor 32 in the chamber 9 the motor is reactivated. When fuel drops below sensor 32 in the chamber 9 and the two sensors 31 and 32 are made then the motor 29 cannot operate and the filling cycle described above for the chamber 9 begins again.

In practice the controller is programmed to raise and lower the floor 5 of the silo 1 in 10 second on and 10 second off cycles when the device 22 is operating. The controller is also adapted to ensure that the suction device 22 and the conveying means 11 can not operate at the same time or the suction device 22 draw burning material into the chamber 9 from the boiler.

The operation of the jets 13 is also controlled in cycles with 4 seconds on and 4 seconds off providing the suction device 22 is operating.

Figure 9:
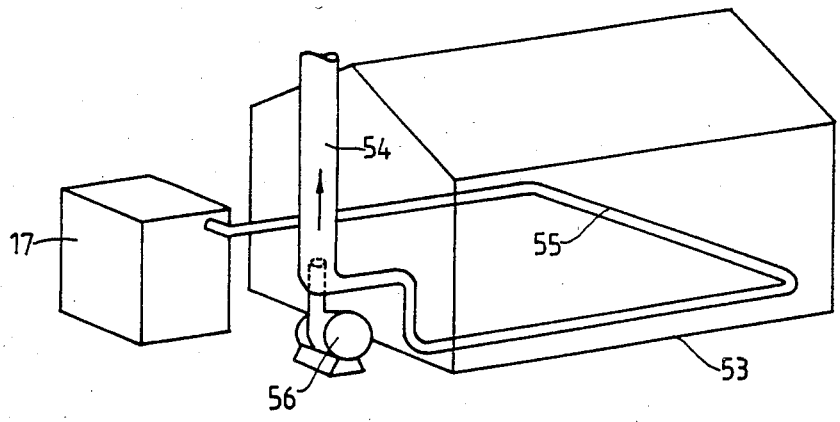
FIG. 9 is a perspective schematic view of a heating unit adapted for use in industrial and agricultural type applications.

In industrial and commercial situations the fuel supply means can be installed with the heating unit as shown in FIG. 9. This construction is sited in association with a glasshouse 53 and can, for example, be a burner 17 connected to appropriate ducting around the periphery of the glasshouse. Air is blown up the flue 54 drawing the combustion exhaust gases from the firebox through the convector pipes 55. The fan 56 is installed to create a forced air draft through the heating coil by drawing in fresh air and blowing same straight up the chimney 54. This obviates the necessity for frequent cleaning off of soot which can clog the fan blades.

It is also envisaged that the convector pipes 55 can include additional fins to increase the heat transfer therefrom.

Figure 10:
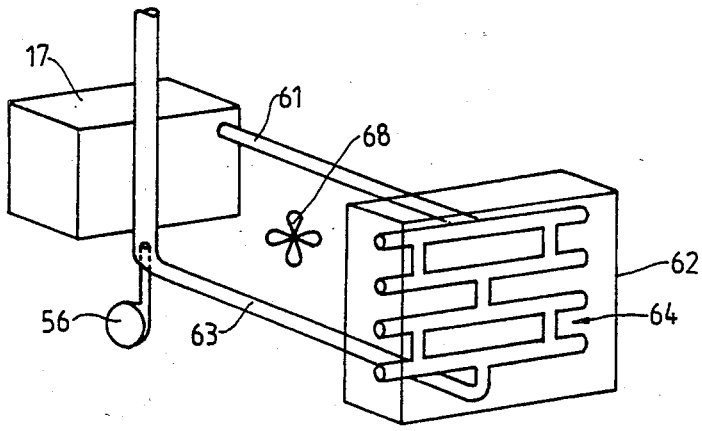
FIG. 10 is a diagrammatic perspective view of a further example of a heating unit in accordance with the invention.
Figure 11:
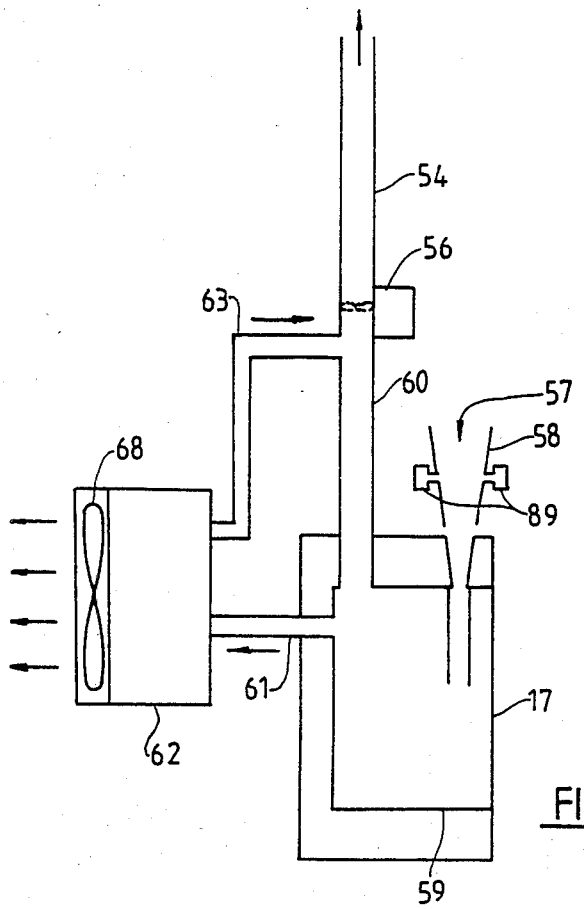
FIG. 11 is a schematic cross-sectional view through yet another heating unit and heating appliance incorporating the invention.

In the alternative construction of burner shown in FIG. 10 the firebox 17 is mounted on a wheeled frame (not shown) at the rear of which is positioned a convector unit 62. The firebox 17 is adapted to preferably burn particulate woodwaste from a timber yard or pulping plant. This construction which is readily transportable is set up at a site where heated air is required. This unit can, for example, be used to temporarily heat a large tent at a fair or a large building which is being used for an exhibition and the like.

It is to be appreciated that the present invention can be used for drying grain, timber, bricks, textiles and in any situation where a large volume of heat is required.

In the heating units the user can include in the firebox 17 a stand pipe and auxiliary air supply to the center and/or rear of the firebox through which additional air is supplied direct to the center of the combustion space. The stand pipe or pipes extend from the grate upwards to a cover around the periphery of which are air outlets through which air is drawn when the fan 56 is operating. This is the construction shown in FIG. 15.

In the heating unit which is shown in FIGS. 11 to 16 the heating unit is designed for placement in a glasshouse.

Figure 13:
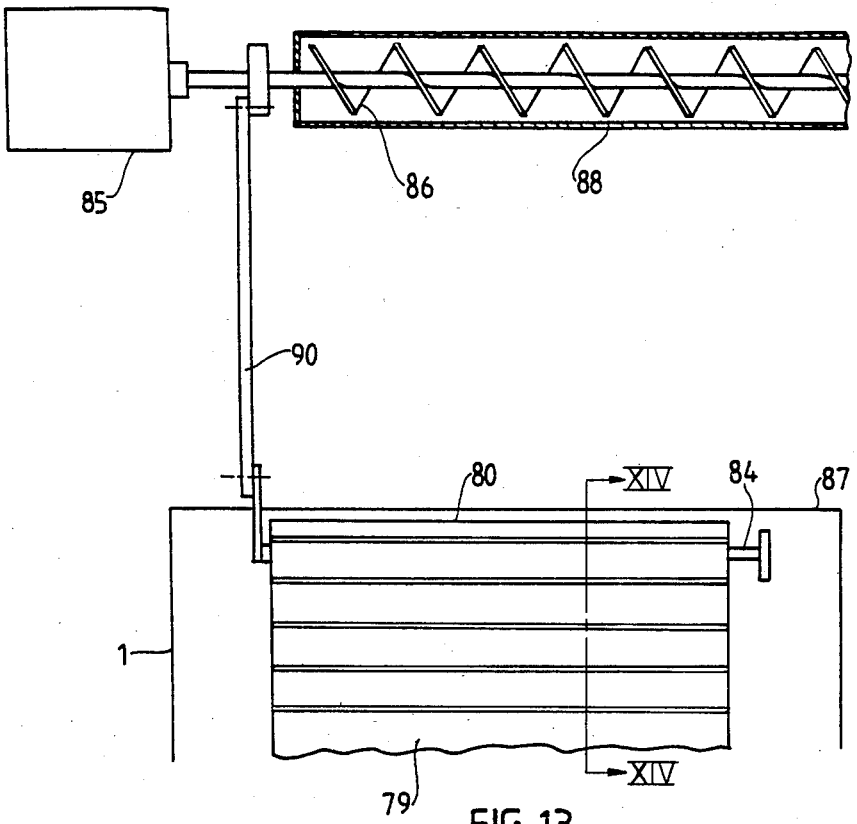
FIG. 13 is an enlarged schematic plan view partly in cross-section of a feeding means for supplying fuel to the heating appliance shown in FIG. 11.
Figure 14:
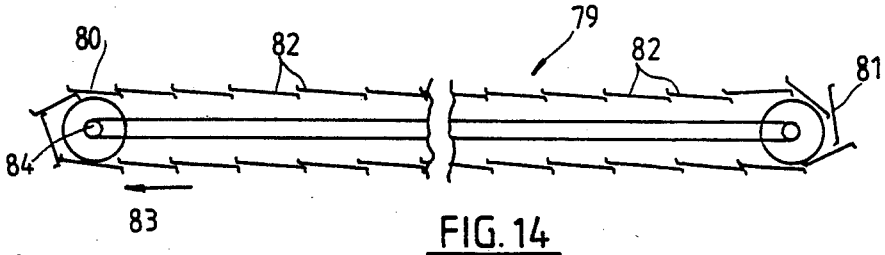
FIG. 14 is a schematic cross-sectional view taken along line XIV—XIV through the endless conveyor shown in FIG. 13.

The heating unit has a convector unit 62 associated with an enclosed firebox 17 which is fed by a feeding means shown in detail in FIGS. 13 and 14. The fuel which is advantageously woodwaste particles drops in the direction of the arrow 57 into a fuel supply chute 58 which terminates above the center of grate 59. The firebox 17 has a door (not shown) to allow access for cleaning and/or repair. The firebox 17 includes a direct connection 60 to a flue 54. The direct connection 60 is only used when starting a fire in the firebox and is closed by a baffle (not shown).

The combustion gases when the heating appliance is operating pass through a flue duct opening 61 to a convector unit 62 before passing to a return duct 63.

Figure 12:
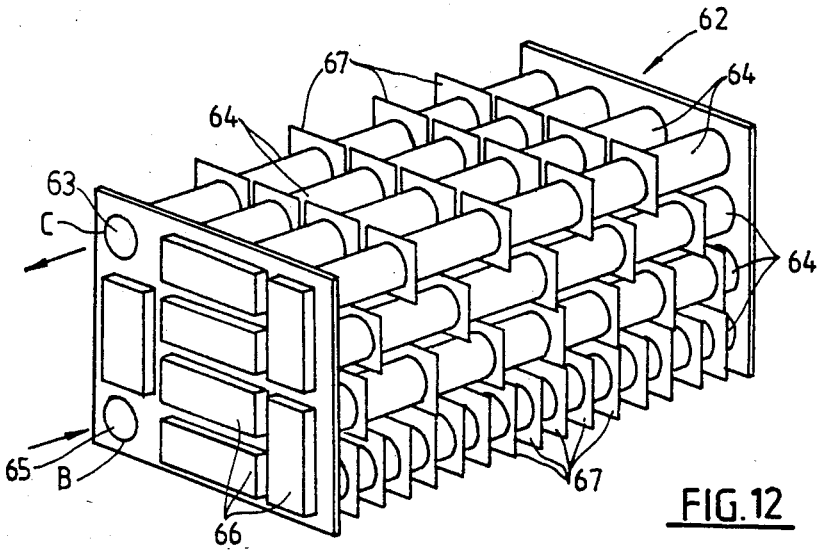
FIG. 12 is an enlarged perspective view from above of a heating unit usable with the appliance shown in FIG. 11.

The convector unit 62 is shown in more detail in FIG. 12. The convector unit 62 includes a series of convector pipes 64 which are connected at the ends thereof to form a circuitous path from an inlet duct 65 at 'B' to the return duct 63 at C. Manifolds 66 at one end of each pipe 64 are removable to allow the pipes 64 to be cleaned. The pipes 64 have fins 67 and more fins are positioned on the lower hotter pipes 64 than on the upper cooler pipes (as shown in FIG. 12).

The convector unit 62 has a circulating fan 68 associated therewith to increase heat transfer from the pipes 64 and fins 67. The convector unit 62 with the associated circulating fan 68 are mounted in a housing (not shown) with safety screens.

Figure 16:
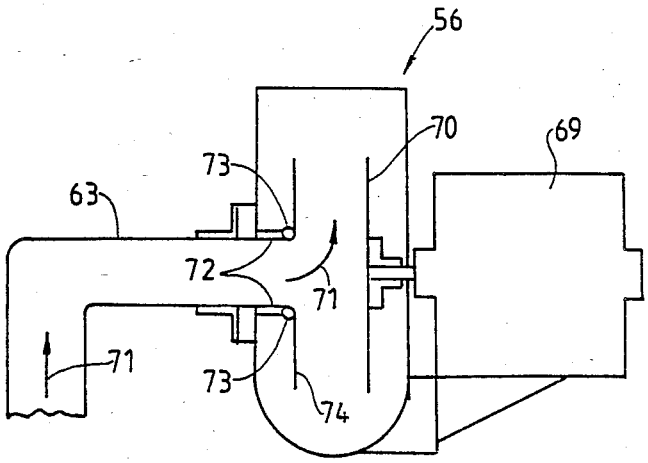
FIG. 16 is a schematic view of a fan means usable with the present invention.

The combustion gases are drawn through the unit 62 by the fan 56 an example of which is shown in detail in FIG. 16. The fan 56 is electrically driven by motor 69 and has a centrifugal impeller 70 which draws air in the direction of arrows 71. The return duct 63 includes an extension 72 the end of which terminates in a ring seal 73 which is in contact with the side 74 of the impeller 70. The existence of the seal 73 improves the effectiveness of the fan as no air is drawn from around the edge of the opening in the side 74 as has been the case in the past with existing fans of this type.

Figure 15:
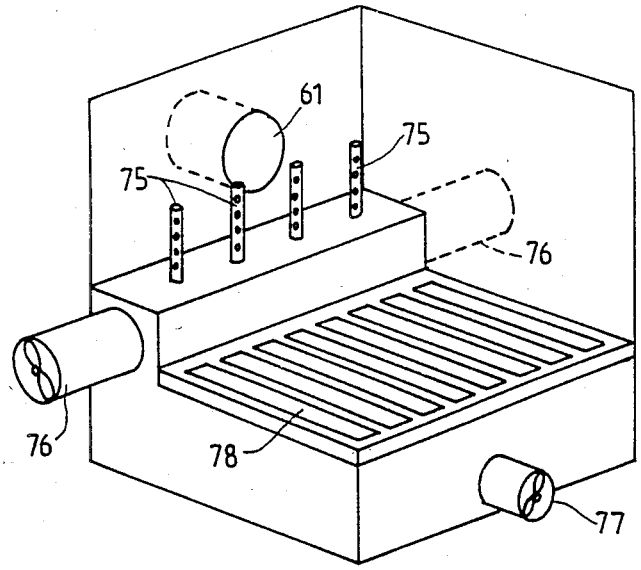
FIG. 15 is a schematic perspective view of the interior of a firebox usable with a heating appliance according to the invention.

The combustion chamber 17 can include the features of FIG. 15 wherein auxiliary air is supplied by stand pipes 75 each of which has a plurality of holes. The air is supplied via dampers 76. In addition or alternatively the air for combustion can be supplied via a damper 77 to the grate 78.

The fuel is supplied generally from a situation remote from the combustion chamber 17 and examples of fuel supply means are shown in FIGS. 1 to 8 and 13 and 14 respectively. The example of fuel supply means of FIGS. 1 to 8 has been described hereinbefore. In the alternative construction shown in FIGS. 13 and 14 the fuel is stored in a covered hopper 1 only part of which is shown in FIG. 13. The hopper 1 has positioned in the top thereof an endless conveyor 79 one end 80 of which is supported at one side of the hopper 1. The other end 81 floats on top of the fuel in the hopper and gradually drops down as the fuel is removed. The endless conveyor 79 is a series of slats 82 (FIG. 14) mounted on a pair of chains and/or linked together so that they rotate in the direction of arrow 83. The end 80 is mounted on a driven shaft 84 the drive for which is from a prime mover 85 adapted to drive a feed conveyor 86. A drive shaft connection 90 can be used. The fuel moved by the endless conveyor 79 drops over the edge 87 of the hopper 1 to fall under gravity to the feed conveyor 86 or drops down a panel to the level of the conveyor 86.

The conveyor 86 can be a worm or screw conveyor mounted in a generally level trough 88 the other end of which is above the fuel chute 16. The prime mover 85 is ideally electrically operated on an automatic stop start basis by electronic means 89 associated with chute 16.

In use with a full hopper 1 of fuel a fire is initially lit in combustion chamber 17 with the direct connection 60 to the flue 54 open.

When combustion has begun the fan 56 is operated and the direct connection 60 closed.

The exhaust or combustion gases pass to the convector unit 62 under the action of the fan 56. The convector fan 68 is operated to spread the heat from the convector unit 62 to the space in which it is positioned. Preferably the combustion chamber and convector unit 62 are close together so that the benefits of radiant heat are also obtained. The level and supply of fuel is maintained by the feed means in which the slats 83 draw off the fuel from the supply in the hopper 1 and drop it down in the direction of the conveyor 86. The conveyor 86 continues to operate until it is automatically shut off when fuel has built up to above the level of the electronic sensors 89. When fuel has dropped below this level the conveyor 86 is activated again.

The control system for the unit includes automatic protection against accidental shut down of the fan 56 in which case the conveyor 86 is automatically stopped. In addition a maximum temperature sensor may be included to shut down the unit if the temperature in the space reaches a preset maximum.

Thus by this invention there is provided a heating unit which efficiently uses heat normally lost to atmosphere through a flue of a central heating unit or other fire.

Examples of the present invention have been described herein and it is envisaged that improvements and modifications thereto can take place without departing from the scope and spirit of the appended claims.

What I do claim and desire to obtain by Letters Patent of the United States is:

1. An apparatus for supplying fuel to a heating unit comprising:

a fuel material storage silo;

a concave base in said silo;

a silo outlet port in the central portion of said concave base;

an inflatable floor liner on said concave base for loosening material stored thereon by inflating said liner;

a feed tube having one end thereof connected to said outlet port;

a combustion chamber;

a fuel supply chamber operatively connected to said combustion chamber for feeding fuel material therein to the combustion space of said combustion chamber;

said feed tube having another end connected to said fuel supply chamber; and a suction device operatively connected to said fuel supply chamber for drawing fuel material from said silo through said feed tube to said supply chamber.

2. An apparatus as claimed in claim 1 and further comprising:

a conveyor means operatively associated with said fuel supply chamber for receiving fuel material therefrom and feeding said fuel material to said combustion space of said combustion chamber.

3. An apparatus as claimed in claim 1 wherein: said storage silo is vented and said inflatable floor liner is annular in shape.

4. An apparatus as claimed in claim 2 wherein: said fuel supply chamber comprises a cylinder mounted with its axis vertical and has a tangential inlet to which said another end of said feed tube is connected and a base; and said conveyor means is disposed in said base of said fuel supply chamber.

5. An apparatus as claimed in claim 2 wherein: said suction device is connected by at least one tube to a suction outlet in the top of said cylinder; and said suction device has a series of fans which draw air and entrained material from said storage silo via said feed tube to said fuel supply chamber where said fuel material drops out and the air passes through said at least one tube to said suction device from which it exits via an outlet therein.

6. An apparatus as claimed in claim 5 and further comprising: a cyclone filter; and wherein said at least one tube comprises a tube connecting said cylinder to said cyclone filter and a further tube connecting said cyclone filter to said suction device.

7. An apparatus as claimed in claim 2 wherein: said conveyor means comprises a transverse worm feed mounted across said base of said chamber.

8. An apparatus as claimed in claim 7 wherein: said worm feed is operatively connected to a pair of disc members for moving material across said base of said chamber, each disc member having lugs on the surface thereof which rotate when the worm feed rotates to thereby move material from the edges of said chamber to said worm feed.

9. An apparatus as claimed in claim 8 and further comprising; a pair of sensing means supported on said chamber for controlling drive motors operatively connected to said worm feed and suction device.

10. An apparatus as claimed in claim 9 wherein: said pair of sensing means comprises a pair of infra-red transmitters and corresponding reflectors operatively associated therewith, each sensing means being shrouded by an inverted V-shaped, in cross-section, particle stream splitter positioned thereabove.

11. An apparatus as claimed in claim 10 wherein: each particle stream splitter covers a self-cleaning window, said window being supported by a pair of plastic fittings a part of which is disposed on the outside of said chamber, and at least one aperture is provided in said outside part through which air is drawn by the suction of said suction device so that a flow of air is produced across said window to maintain said window clear.

12. An apparatus as claimed in claim 3 wherein: said heating unit comprises a heating unit having said combustion chamber incorporated therein and a shaped convection flue duct connected at one end with said combustion chamber; and further comprising a heating appliance having at least one convection pipe therein connected to the other end of said convection flue duct; and fan means operatively associated with said convection flue duct to draw flue gases from said heating unit through said flue duct and through said at least one convection pipe before the flue gases return to an exhaust flue to escape to atmosphere.

13. An apparatus as claimed in claim 12 wherein: said convection pipe has the form of a continuous serpentine shape within said heating appliance.

14. An apparatus as claimed in claim 12 wherein: said heating appliance comprises a free standing convection assembly in which said at least one convection pipe is situated and around which ambient air circulates to be heated in a space in said heating appliance in which the convection pipe is situated.

15. An apparatus as claimed in claim 14 adapted for use in an industrial, horticultural or agricultural situation wherein: said free standing convection assembly is operatively associated with the interior of a glass house or a factory so that heat from the flue gas can be used for heating the interior.

16. An apparatus as claimed in claim 14 wherein: said combustion chamber of the heating unit has at least one standpipe positioned therein for supplying auxiliary air thereto.

17. An apparatus as claimed in claim 12 wherein: said fan means comprises a centrifugal fan positioned in said flue duct so that gases are drawn into the centrifugal fan through a central inlet thereof, the periphery of said central inlet being sealed by a seal in contact with a side of the centrifugal fan in which said central inlet is formed.

18. An apparatus as claimed in claim 14 wherein: said at least one convection pipe includes removable members for allowing access thereto for cleaning and maintenance; and further comprising an air circulating fan operatively associated with said heating appliance for circulating air over said serpentine-shaped pipe.

19. An apparatus as claimed in claim 15 wherein: the heating unit and heating appliance are mounted on a wheeled frame for transportation from site to site.

* * * * *